United States Patent [19]

Belcourt

[11] Patent Number: 4,733,472

[45] Date of Patent: Mar. 29, 1988

[54] CAN OPENER BLADE

[76] Inventor: Neale Belcourt, 71 Hourigan Dr., Meriden, Conn. 06450

[21] Appl. No.: 902,760

[22] Filed: Sep. 2, 1986

[51] Int. Cl.[4] ..... B67B 7/54

[52] U.S. Cl. ..... 30/422; 30/347; 30/425; 30/440

[58] Field of Search ..... 30/418, 422, 424, 425, 30/440, 441, 347

[56] References Cited

U.S. PATENT DOCUMENTS 2,383,929 8/1945 Landry ..... 30/422

3,075,322 1/1963 Uthoff ..... 30/424 X

*Primary Examiner*—Douglas D. Watts

*Attorney, Agent, or Firm*—CTC & Associates

[57] ABSTRACT

This invention provides a can opener blade wherein the two primary sides forming the bevelled cutting edge have a certain angular relationship with the centerline of said blade; the blade of this invention has certain advantages over known can opener blades.

2 Claims, 5 Drawing Figures

CAN OPENER BLADE

This invention deals with a circular can opener blade having an improved configuration; also, said blade is adaptable for use on most commercially available can openers.

BACKGROUND OF THE INVENTION

Manual or motorized means for opening cans have been in use for many years, yet, there is a tendency that with extended use, the circular blades of such means become dull and fail to cut through the edges of metal cans. Finding a replacement for such blades may cause a problem especially with older can opener models because of unavailability or obsolescense, yet, all other parts of the can opener may be in good working order. Furthermore, the blades generally used on a can opener seem to fail to cut as efficiently and deeply as desired; the instant blade allows a deep and thorough cut through the can tops including around the relatively sharp corners of square or rectangular designed can tops such as found, for instance, with sardine cans.

Typical approaches to can openers and blades therefor are represented by the following references of interest:

U.S. Pat. No. 2,602,991 (Landry) teaches a can opener including, among other things, a cutter wheel whose cutting edge is formed by slanted sides; nowhere is there any indication that the cutter wheel is usuable in other than the can opener of this reference.

U.S. Pat. No. 2,647,307 (Landry) discloses a can opener cutter assembly which uses a cutter wheel similar to that described in the above reference.

U.S. Pat. No. 2,810,952 (Sundell) is concerned with a can opener which includes a double conical cutter wheel, and there is no mention of adaptability of said cutter wheel to other can openers.

U.S. Pat. No. 2,893,117 (Landry) describes a can opener and cutter assembly wherein the cutter wheel's edge is obtained by double slanted sides; no mention is made of adaptability means for other can openers.

SUMMARY OF THE INVENTION

It is, therefore, an object of this invention to provide a circular blade having a new design for more efficient cutting ability;

It is another object of this invention to provide a can opener blade being rotatably adaptable to many commercially available can openers;

It is still another object of this invention to provide means for cutting more readily around sharp cornered metal cans;

It is also an object of this invention to provide a blade cutting deeper into cans which is especially useful for opening cans having shortened lips;

It is still a further object of this invention to allow extended life of can openers now being unusable due to dull blades or unavailability of proper size blades;

Other objectives shall become apparent in the appended description and claims.

PREFERRED EMBODIMENTS OF THIS INVENTION

Figure 1:
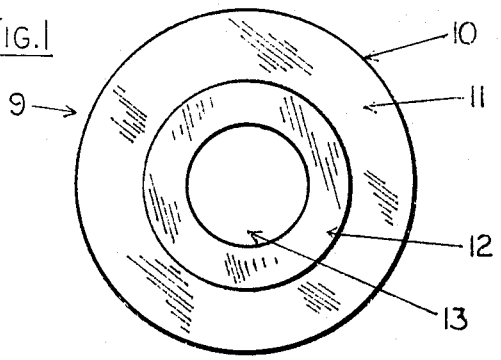
FIG. 1 is a front elevated view of a blade of this invention.
Figure 2:
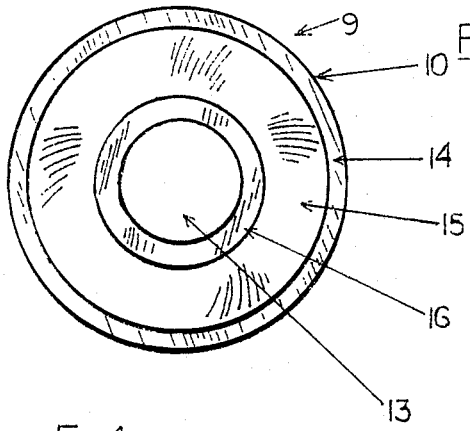
FIG. 2 is a back elevated view of a blade of this invention.
Figure 3:
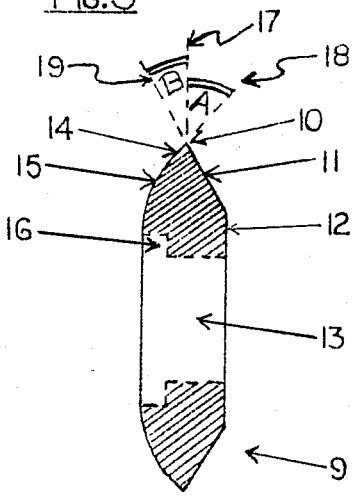
FIG. 3 is a side elevational view of a blade of this invention.

The above objects of the invention are achieved by providing an improved circular blade for use with a can opener, said blade having certain distinct features as illustrated in FIGS. 1, 2, and 3, wherein blade 9 has a bevelled edge 10 formed by straight side 11 and index side 14, the latter being extended by preferably outwardly curved portion 15 to annular spring recess 16; straight side 11 leads to flat support region 12; all penetrated by annular hole 13. It is important that certain blade dimensions and relations are observed in order to meet the objects of this invention, namely, imaginary index angle A formed (see FIG. 3 at point 10) by centerline 17 and extension 18 of index side 14; said angle being 40–50 degrees, preferably 43–47 degrees, and most preferably 45 degrees; the side angle B formed at point 10 by centerline 17 and extension 19 of straight side 11 ought to be 20–35 degrees, preferably 22–30 degrees, and most preferably 25–28 degrees; the portion 15, when rounded, may have a curvature based on a radius of 0.3–0.75 inch, preferably 0.4–0.65 inch, and usually 0.45–0.55 inch, and generally extending over an arc of 18–28 degrees; the width of index side may be 0.015–0.1 inch, preferably 0.02–0.0625 inch, most preferably 0.03–0.04 inch; the annular centers hole 13 may have a diameter of 0.2–0.4 inch, preferably 0.25–0.35 inch, most preferably 0.26–0.31 inch; said hole diameter being the inner diameter of support region 12, the latter's outer diameter exceeding the hole 13 diameter by at least 0.04 inch, preferably by at least 0.08 inch, and most preferably at least by 0.12 inch; the spring recess 16 has a depth of 0.015–0.25 inch, preferably 0.025–0.15 inch, and preferably 0.03–0.1 inch; with the outer diameter of said recess 16 being exceeding the diameter of annular hole 13 by at least 0.01 inch, preferably by 0.04 inch, most preferably by at least 0.08 inch.

Figure 4:
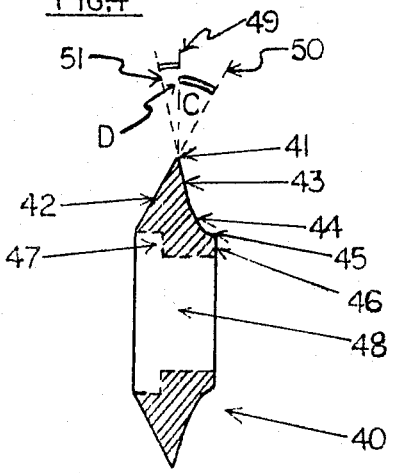
FIG. 4 is a side elevated view of a commercial can opener blade outside this invention.

A comparison of the blade 9 of this invention with a blade typically representative of commercial automatic can openers highlights decisive differences and distinctions: as described in FIG. 4 blade 40 has a bevelled edge 41 formed by slanted sides 42 and 43, whereby side 42 terminates at recess 47, whereas side 43 leads to outward slanted side 44 which is extended by still further outward slanted support side 45, the latter being terminated by support region 46; all penetrated by annular hole 48. Imaginary angle C at point 41 formed by centerline 49 and extention 50 of side 42 is only about 30 degrees, whereas corresponding angle A of the blade of this invention has to be 40–50 degrees, i.e. angle A has to be 33% or more wider than angle C of the prior art blade; it has unexpectedly been found that this angle is indeed critical especially when cutting around the corners of cans; similarly, imaginary angle D of commercial blade 40 formed at point 41 by centerline 49 and extension line 51 of side 43 is about 15 degrees, whereas corresponding angle B of a blade of this invention should be above 20–35 degrees, i.e. from 33–133% greater than the angle D of the prior art blade 40; furthermore, side 42 of blade 40 exhibits not the slightest curvature; whereas corresponding side 15 of a blade of this invention preferably is designed to have some rounded shape as indicated above. Generally, annular hole 13 of blade 9 of this invention usually has a diameter somewhat greater than that found with commercial or prior art blades for reasons further being discussed below; also, the overall diameter of the blade of this invention may be 0.7–1.0 inch, preferably 0.75–0.95 inch, most preferably 0.82–0.85 inch, whereas the overall width of the blade is 0.10–0.25 inch, preferably 0.125–0.20 inch, most preferably 0.15–0.17 inch.

Commercial automatic can openers usually have the blades fairly snugly mounted on a shaft which extends from the main body of the opener, with a spring between blade and can opener pressing the blade against retaining means, customarily a pan head type screw.

Figure 5:
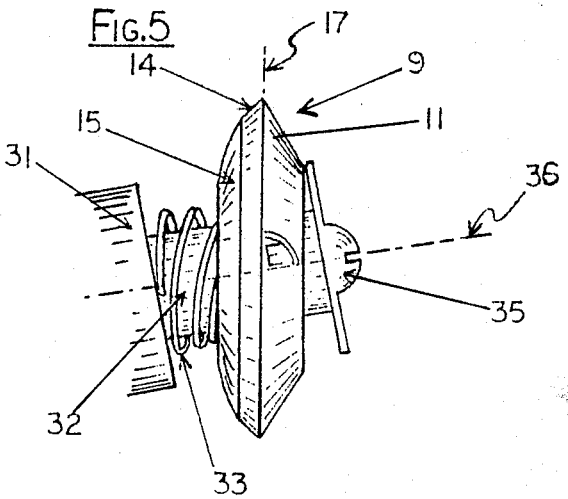
FIG. 5 is a side elevated side view of a blade of this invention mounted on a shaft of a can opener.

Replacing a blade of a commercial can opener with a blade of this invention is usually an easy matter: having removed the old blade, reassembly with a blade of this invention is accomplished as shown in FIG. 5 by placing spring 33 over shaft 32 extending from shaft support 31 (the bulk of the can opener not shown), then slipping the blade 9 of this invention onto the shaft 32 with index side 14 and (curved) portion 15 facing the shaft support 31 (or the can opener; not shown), and the spring is resting within spring recess; the blade 9 is then held in place by screw 35. The blade ought to be readily rotatable.

It will be noted that FIG. 5 indicates a certain degree of freedom of the blade 9 of this invention on shaft 32 against the pressure of spring 33, which, when not under stress, will tend to hold the blade at a ninety degree angle in relation to the shaft. However, it has been unexpectedly found that a certain degree of flexibility of the blade is most desirable because it enables the balde to more readily manoeuver along the lip of a can and around corners. The degree of freedom for the purpose of this invention may be expressed by the imaginary angle E formed by centerline 17 of the blade 9 of this invention and the centerline 36 of the can opener shaft 32; said angle E should be 90 degrees plus/minus 5–30 degrees, preferably plus/minus 8–25 degrees, most preferably plus/minus 10–20 degrees.

The materials of construction for the blade may suitably chosen from hardened and/or stainless steel or other extra hard metals such as tantalum or titanium.

Although there may be other variations of the blade of this invention, the use thereof it is believed that they fall well within the scope and spirit of this invention as expressed in the appended claims.

What is claimed is:

1. A circular can opener blade comprising a bevelled edge formed by a slanted straight side and a slanted index side, said index side being extended by an outwardly curved portion which leads into a recessed portion, said straight side being terminated by a flat support region; all penetrated by an annular hole; wherein the index angle formed by the centerline of said blade and by said index side is 43–47 degrees, the side angle formed by said centerline and said slanted straight side is 22–30 degrees, said outwardly curved portion has a radius of 0.4–0.65 inch, and said annular hole has a diameter of 0.26–0.31 inch allowing a degree of freedom expressed by the angle formed by the centerline of a can opener shaft and by the centerline of said blade of 90 degrees plus/minus 10–20 degrees.

2. A can opener having attached to a shaft thereof a circular can opener blade comprising a bevelled edge formed by a slanted straight side and a slanted index side, said index side being extended by an outwardly curved portion which leads into a recessed portion, said straight side being terminated by a flat support region; all penetrated by an annular hole; wherein the index angle formed by the centerline of said blade and by said index side is 43–47 degrees; the side angle formed by said centerline and by said straight side is 22–30 degrees; wherein the degree of freedom expressed by the angle formed by the centerline of said shaft and by the centerline of said blade is 90 degrees plus/minus 8–25 degrees.

* * * * *